US009250587B2

(12) United States Patent
Tamada et al.

(10) Patent No.: US 9,250,587 B2
(45) Date of Patent: Feb. 2, 2016

(54) IMAGE FORMING APPARATUS THAT ADJUSTS A DIFFERENTIAL SPEED BETWEEN A SURFACE OF A FIXING BELT AND A SURFACE OF A PRESSURE ROLLER BASED ON A DETECTED TORQUE OF A MOTOR THAT DRIVES THE PRESSURE ROLLER

(71) Applicant: KONICA MINOLTA, INC., Chiyoda-ku, Tokyo (JP)

(72) Inventors: Takeshi Tamada, Toyohashi (JP); Kenji Izumiya, Hachioji (JP); Satoshi Ogata, Hachioji (JP); Masahito Takano, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/294,432

(22) Filed: Jun. 3, 2014

(65) Prior Publication Data

US 2014/0363185 A1 Dec. 11, 2014

(30) Foreign Application Priority Data

Jun. 11, 2013 (JP) ..... 2013-122666

(51) Int. Cl.
*G03G 15/20* (2006.01)

(52) U.S. Cl.
CPC ..... *G03G 15/2064* (2013.01); *G03G 15/2028* (2013.01); *G03G 2215/2032* (2013.01); *G03G 2215/2045* (2013.01)

(58) Field of Classification Search
CPC ..... G03G 2215/2045
See application file for complete search history.

(56) References Cited

U.S. PATENT DOCUMENTS

| | | | | |
|---|---|---|---|---|
| 5,359,401 | A | 10/1994 | Uehara et al. | |
| 8,463,150 | B2 | 6/2013 | Yoshikawa | |
| 2010/0226700 | A1* | 9/2010 | Yamada | G03G 15/2089 399/329 |
| 2013/0121716 | A1* | 5/2013 | Okuno | G03G 15/2053 399/67 |

FOREIGN PATENT DOCUMENTS

| | | | |
|---|---|---|---|
| JP | 06-250560 | A | 9/1994 |
| JP | 09-138598 | A | 5/1997 |
| JP | 10-221999 | A | 8/1998 |
| JP | 2007-163946 | * | 6/2007 |
| JP | 2010256696 | A | 11/2010 |

OTHER PUBLICATIONS

Japanese Office Action (and English translation thereof) dated Jun. 9, 2015, issued in counterpart Japanese Application No. 2013-122666.

* cited by examiner

*Primary Examiner* — Clayton E Laballe
*Assistant Examiner* — Peter L Cheng
(74) *Attorney, Agent, or Firm* — Holtz, Holtz & Volek PC

(57) ABSTRACT

An image forming apparatus comprises a drive motor configured to rotate the lower pressure roller, a torque generation unit for generating a braking force in the direction to hinder rotation of a fixing belt in order to adjust the differential speed between the surface speed of the fixing belt and the surface speed of the lower pressure roller, and a control unit for adjusting the braking force generated by the torque generation unit. The control unit adjusts the braking force generated by the torque generation unit to decrease if the rotational torque of the drive motor is larger than a predetermined target torque, and increase if the rotational torque of the drive motor is smaller than the predetermined target torque.

11 Claims, 7 Drawing Sheets

IMAGE FORMING APPARATUS THAT ADJUSTS A DIFFERENTIAL SPEED BETWEEN A SURFACE OF A FIXING BELT AND A SURFACE OF A PRESSURE ROLLER BASED ON A DETECTED TORQUE OF A MOTOR THAT DRIVES THE PRESSURE ROLLER

CROSS-REFERENCE TO RELATED APPLICATIONS

The present application claims priority under 35 U.S.C. §119 to Japanese Patent Application No. P2013-122666, filed Jun. 11, 2013. The contents of this application are herein incorporated by reference in their entirety.

BACKGROUND OF THE INVENTION

1. Field of Invention

The present invention relates to an image forming apparatus based on an electrophotographic system, an electrostatic recording system or the like system.

2. Description of Related Art

In general, an image forming apparatus as an electrophotographic system (printer, copying machine, facsimile or the like) is provided with a fixing unit for applying heat and pressure to a sheet to fix a toner image transferred to the sheet. This fixing unit includes a heating unit for heating and melting toner on a sheet and a pressing unit for pressing the sheet against the heating unit.

The pressing unit of the fixing unit consists, for example, of a fixing roller and a pressure roller which is urged against the fixing roller with a predetermined load. A nip portion is formed between the fixing roller and the pressure roller which is directly or indirectly urged against the fixing roller to hold and convey a sheet therebetween.

The heating unit of the fixing unit consists of a heat source (for example, halogen heater) contained in the pressure roller, and an endless fixing belt which is wound around the fixing roller (heating belt type). In this case, a nip portion is formed by urging the pressure roller against the fixing roller through the fixing belt. Alternatively, the fixing roller may incorporate a heat source, and serves itself as a heating unit (heating roller type). In this case, the pressure roller is urged directly against the fixing roller while a nip portion is formed therebetween.

The image forming apparatus having such a fixing unit develops toner images on photoreceptor drums in correspondence with image data, and transfers the toner images on a sheet. The sheet with the transferred toner images is conveyed to the fixing unit, and passed through the nip portion to fix the toner images with heat and pressure.

This kind of fixing unit is described, for example, in Japanese Patent Published Application No. 06-250560, Japanese Patent Published Application No. 10-221999, and Japanese Patent Published Application No. 09-138598.

In the case of the fixing units described in Japanese Patent Published Application No. 06-250560 and Japanese Patent Published Application No. 10-221999, a nip portion is formed with a fixing roller on which is partly wound an endless belt running around a plurality of rollers. The fixing unit includes a pressure roller located in contact with the fixing roller through the endless belt from the inside of the endless belt at the exit of the nip portion. The fixing unit prevents displacement of images by exerting a braking force on the endless belt conveyed on the pressure roller in order to remove the difference in the conveyance speed between the pressure roller and the fixing roller. On the other hand, in the case of the fixing unit described in Japanese Patent Published Application No. 09-138598, a heat-resistant belt is supported by a plurality of rollers around which this belt is wound. This fixing unit includes a pressure roller urged in contact with a plurality of rollers through the heat-resistant belt. A tension is given to the heat-resistant belt by controlling the plurality of rollers.

When fixing toner in the fixing unit, the surface of a sheet bearing an unfixed toner image comes in direct contact with a heating unit (fixing belt or fixing roller). Accordingly, a latent image may be formed on the heating unit with wax, which is soaked from toner and attached to the heating unit (fixing belt or fixing roller), and may appear on the next image. More specifically, when fixing toner to form the next image, the wax attached to the heating unit appears as the unevenness of gloss (referred to as a gloss memory) corresponding to the unevenness of the attached wax amount.

There is a demand to clear such a gloss memory when fixing toner in a fixing unit and improve the image quality. However, such a gloss memory cannot be prevented from occurring in the fixing units described in Japanese Patent Published Application No. 06-250560, Japanese Patent Published Application No. 10-221999, and Japanese Patent Published Application No. 09-138598.

SUMMARY OF THE INVENTION

To achieve at least one of the abovementioned objects, an image forming apparatus comprises: a fixing side member configured to rotate; a back side member configured to rotate in contact with the outer peripheral surface of the fixing side member under pressure, and cooperate with the fixing side member for forming a fixing nip portion and holding and conveying a sheet with a toner image therebetween; a drive motor configured to rotate the back side member; a braking force generation unit configured to generate a braking force in the direction to hinder rotation of the fixing side member to set a differential speed between the surface speed of the fixing side member and the surface speed of the back side member; a control unit configured to adjust the braking force generated by the braking force generation unit; and a torque detection unit configured to detect the rotational torque of the drive motor, wherein the control unit adjusts the braking force generated by the braking force generation unit to decrease if the rotational torque of the drive motor detected by the torque detection unit is larger than a predetermined target torque, and increase if the rotational torque of the drive motor detected by the torque detection unit is smaller than the predetermined target torque.

DETAILED DESCRIPTION OF THE PREFERRED EMBODIMENT

Hereinafter, a description is given of embodiments of the present invention with reference to the drawings.

Figure 1:
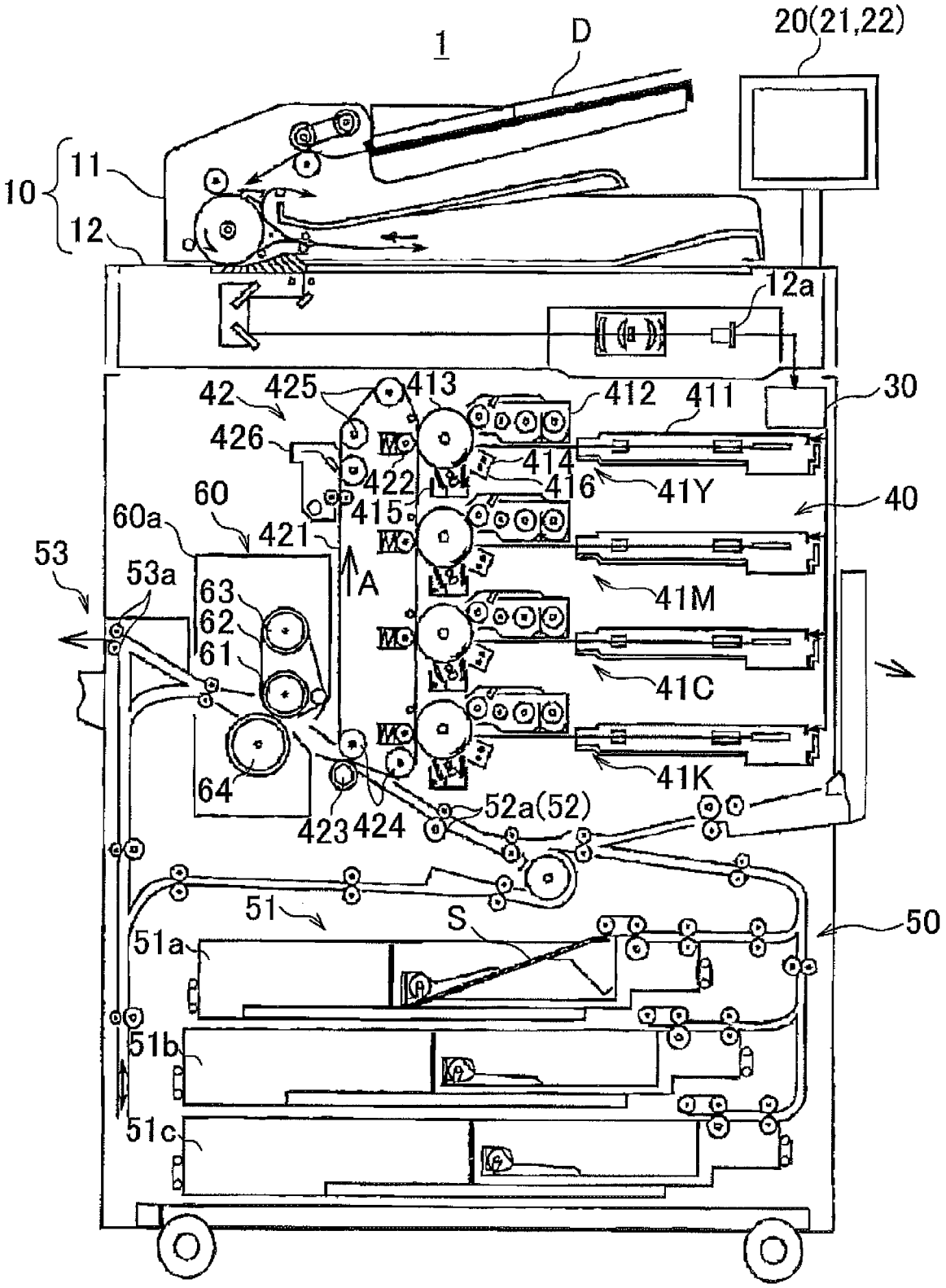
FIG. 1 is a schematic diagram for showing the overall configuration of an image forming apparatus in accordance with an embodiment of the present invention.
Figure 2:
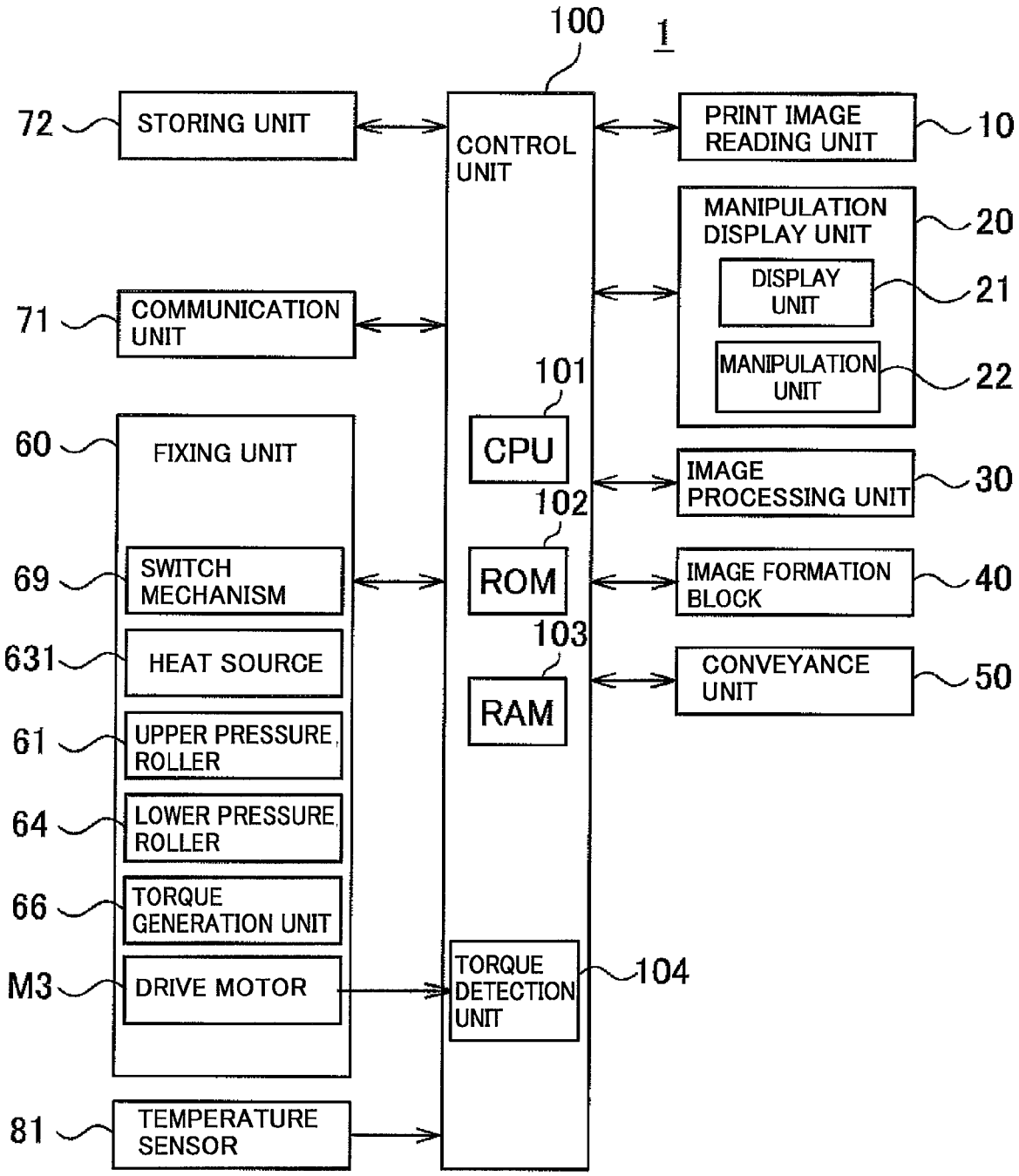
FIG. 2 is a schematic diagram for showing the main architecture of a control system of the image forming apparatus in accordance with the present embodiment.

FIG. 1 is a schematic diagram for showing the overall configuration of the image forming apparatus 1 in accordance with an embodiment of the present invention. FIG. 2 is a schematic diagram for showing the main architecture of a control system of an image forming apparatus 1 in accordance with this embodiment. The image forming apparatus 1 shown in FIG. 1 and FIG. 2 is an intermediate transfer-type color image forming apparatus which makes use of an electrophotographic process technique. This image forming apparatus 1 transfers toner images of respective colors, i.e., C (cyan), M (magenta), Y (yellow) and K (black) to an intermediate transfer member (as a first transfer process). After superimposing four color toner images on the intermediate transfer member, an image is formed on a sheet by transferring the superimposed toner images (as a second transfer process).

The image forming apparatus 1 is provided with photoreceptor units which are serially arranged in the running direction of the intermediate transfer member corresponding to the four colors C, M, Y and K respectively. The image forming apparatus 1 is based on a tandem system which successively transfers four color toner images on the intermediate transfer member in one cycle.

As shown in FIG. 1 and FIG. 2, the image forming apparatus 1 includes a print image reading unit 10, a manipulation display unit 20, an image processing unit 30, an image formation block 40, a conveyance unit 50, a fixing unit 60, a communication unit 71, a storage unit 72 and a control unit (control means) 100.

The control unit 100 includes a CPU (Central Processing Unit) 101, a ROM (Read Only Memory) 102 and RAM (Random Access Memory) 103 and the like. The CPU 101 reads a program from the ROM 102 in accordance with a task, loads the program in the RAM 103, and run the program to control the operations of the respective blocks of the image forming apparatus 1 integrally. At this time, the control unit 100 refers to a variety of data stored in the storage unit 72. The storage unit 72 stores various data items required for fixing process in the fixing unit 60. The storage unit 72 consists of a nonvolatile semiconductor device (so-called flash memory), a hard disk drive or the like.

The control unit 100 performs, through the communication unit 71, transmission to and reception from an external device (for example, a personal computer) which is connected to a LAN (Local Area Network), a WAN (Wide Area Network) or the like communication network. The control unit 100 receives image data, for example, from an external device, and forms an image on a sheet on the basis of this image data (input image data). The communication unit 71 consists, for example, of a communication control card such as a LAN card.

The print image reading unit 10 is provided with an automatic page feeding unit 11 called an ADF (Auto Document Feeder), an original image scanning unit (scanner) 12 and the like.

The automatic page feeding unit 11 conveys an original D by a conveyance mechanism and transfers the original D to the original image scanning unit 12. The automatic page feeding unit 11 is capable of successively feeding a number of originals D to scan the images of the originals D (inclusive of the images of the back sides) collectively with the original image scanning unit 12.

The original image scanning unit 12 optically scans an original, which is conveyed from the automatic page feeding unit 11 and placed on a contact glass, and reads the image by imaging light reflected from the original on a light receiving plane of a CCD (Charge Coupled Device) sensor 12*a*. The print image reading unit 10 generates input image data on the basis of the scan data obtained by the original image scanning unit 12. This input image data is processed by the image processing unit 30 in accordance with a predetermined image process.

The manipulation display unit 20 is a liquid crystal display (LCD: Liquid Crystal Display) with a touch panel and serves as a display unit 21 and a manipulation unit 22. The display unit 21 displays various operation screens, image conditions, the operational states of respective functions and so forth in accordance with a display control signal which is input from the control unit 100. The manipulation unit 22 is provided with a numerical keypad, a start key and other various operational keys, accepts various input operations from a user and outputs an operation signal to the control unit 100.

The image processing unit 30 is provided with a circuit or the like which performs digital image processes in accordance with initial settings or user settings. For example, the image processing unit 30 performs a variety of processes with the input image data such as gradation level adjustment, color correction, shading compensation and other various correction processes, and compression processes under the control of the control unit 100. The image formation block 40 is controlled on the basis of the image data processed by these processes.

The image formation block 40 is provided with image forming units 41Y, 41M, 41C and 41K, an intermediate transfer unit 42 and the like for forming an image on the basis of the input image data with colored toners corresponding to a Y component, an M component, a C component and a K component respectively.

The image forming units 41Y, 41M, 41C and 41K corresponding to the Y component, the M component, the C component and the K component shares the same configuration except for the colors of the toners. For the sake of clarity in explanation and illustration, like numerals denote similar elements, and suffixes Y, M, C and K may be added to the ends of the numerals respectively for distinguishing from each other. In FIG. 1, only the constituent elements of the image forming unit 41Y are given reference numerals corresponding to the Y component, but the reference numerals are omitted for the constituent elements of the other image forming units 41M, 41C and 41K.

The image forming unit 41 is provided with an exposing device 411, a development apparatus 412, a photoreceptor drum 413, a charging unit 414, a drum cleaning unit 415, a lubricant coating unit 416 and the like.

The photoreceptor drum 413 consists, for example, of a conductive cylinder (aluminum blank tube) on which an under coat layer (UCL layer), a charge generation layer (CGL layer), and a charge transport layer (CTL layer) are successively stacked as a negative electrification type organic photoconductor (OPC).

The charging unit 414 uniformly charges the surface of the photoreceptor drum 413 having photoconductivity with negative charge. The exposing device 411 consists, for example, of a semiconductor laser and irradiates the photoreceptor drum 413 with a laser light corresponding to an image of the color component which the photoreceptor drum 413 is responsible for. The laser light generates positive charge in the charge generation layer. The generated charge is transported to the surface of the charge transport layer to neutralize the surface charge (negative charge) of the photoreceptor drum 413. An electrostatic latent image is formed on the surface of the photoreceptor drum 413 corresponding to each color component by the potential difference between the surface and the environment.

A developer of each color component (for example, a two-component developer consisting of a magnetic material and a toner and having small particle diameters) is stored in the development apparatus 412, and gets adhered to the surface of the photoreceptor drum 413 to form a toner image by visualizing an electrostatic latent image corresponding to the each color component.

Meanwhile, in this case, the toner stored in the development apparatus 412 is a toner containing dispersed wax (oil less toner). The melting point of the wax contained in this toner is low, i.e., usually no higher than 110° C. This wax may be any one or a mixture of a paraffin-based wax, a polyolefin-based wax and modified matters of them (for example, oxides and grafted matters), a higher fatty acid and a metal salt thereof, an amide wax, an ester-based wax and any other known wax. For example, a higher fatty acid ester-based wax can be used as a preferred wax.

The drum cleaning unit 415 has a drum cleaning blade (hereinafter referred to as DCL blade) which is in slidable contact with the surface of the photoreceptor drum 413. The DCL blade is used to scrape and remove the residual toner which is lingering on the surface of the photoreceptor drum 413 after the first transfer process.

The lubricant coating unit 416 has a lubricant coating brush in the form of a roller which is in slidable contact with the surface of the photoreceptor drum 413. When the photoreceptor drum 413 is rotating, the lubricant coating unit 416 is coating the surface of the photoreceptor with lubricant adhering to the lubricant coating brush.

The intermediate transfer unit 42 is provided with an intermediate transfer belt 421, first transfer rollers 422, a second transfer roller 423, driven rollers 424, non-driven rollers 425 and a belt cleaning unit 426 and so forth.

The intermediate transfer belt 421 is an endless belt which is wound around the driven rollers 424 and the non-driven rollers 425. The intermediate transfer belt 421 is driven by rotation of the driven rollers 424 to run in the direction of arrow A at a constant speed. The first transfer rollers 422 urge the intermediate transfer belt 421 against the photoreceptor drums 413 so that toner images of the respective colors are successively transferred to the intermediate transfer belt 421 as the first transfer process. Then, when the intermediate transfer belt 421 is urged against a sheet S by the second transfer roller 423, the toner image transferred to the intermediate transfer belt 421 as the first transfer process is transferred to the sheet S as the second transfer process.

The belt cleaning unit 426 has a belt cleaning blade (hereinafter referred to as BCL blade) which is in slidable contact with the surface of the intermediate transfer belt 421. The BCL blade is used to scrape and remove the residual toner which is lingering on the surface of the intermediate transfer belt 421 after the second transfer process.

A toner image is formed on the sheet S in this way.

The toner image is fixed on the sheet S by the fixing unit 60. The fixing unit 60 fixes the toner image on the sheet S with heat and pressure. This fixing unit 60 mainly includes an upper pressure roller 61 serving as a fixing roller located in a frame 60*a*, and a lower pressure roller 64 serving as a pressure roller. The fixing unit 60 of the present embodiment employs a belt nip type configuration which will be described below in detail.

The conveyance unit 50 is provided with a paper feed unit 51, a conveyance mechanism 52 and a discharging unit 53. The paper feed unit 51 includes three paper feed tray units 51*a* to 51*c* for storing sheets S (standard sheets, special sheets) which are classified on the basis of paper densities and sizes of sheets and separately stored in the paper feed tray units 51*a* to 51*c* in accordance with predetermined sheet types respectively.

The sheets S stored in the paper feed tray units 51*a* to 51*c* are fed out from the uppermost sheet one by one, and conveyed to the image formation block 40 by the conveyance mechanism 52 equipped with a plurality of conveyance rollers such as the paper stop rollers 52*a*. The orientation and transfer timing of the sheet S which is fed are adjusted by a registration unit including the paper stop rollers 52*a*.

The toner images of the intermediate transfer belt 421 are superimposed on one side of the sheet S by the image formation block 40 as the second transfer process, and fixed by the fixing unit 60 as a fixing process. The sheet S on which the superimposed image is formed is discharged out of the apparatus by the discharging unit 53 having discharging rollers 53*a*.

Figure 3:
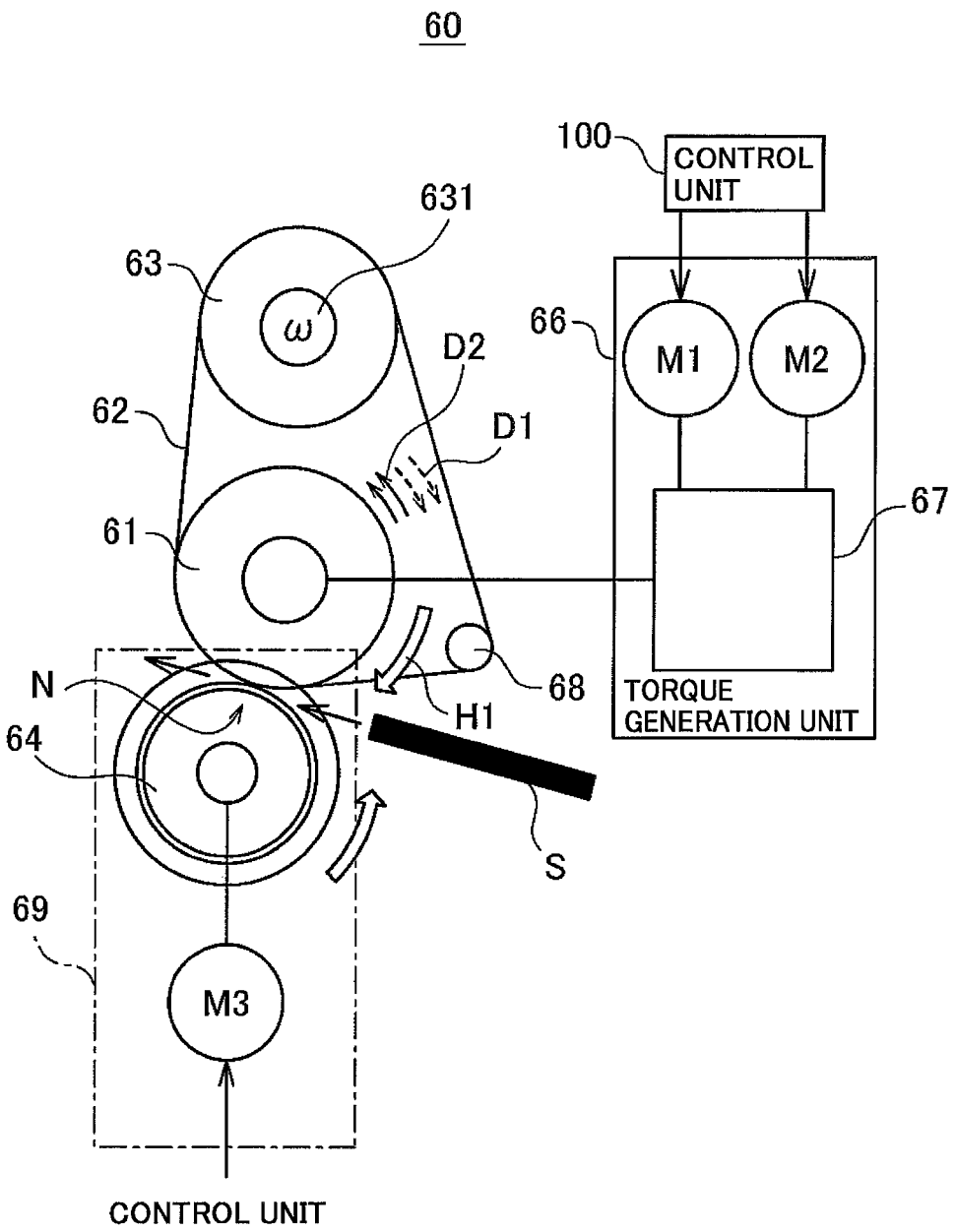
FIG. 3 is a schematic diagram for showing the configuration of the fixing unit shown in FIG. 1.

In what follows, the configuration of the fixing unit 60 of the present embodiment will be explained in detail with respect to FIG. 3. FIG. 3 is a schematic diagram for showing the configuration of the fixing unit 60 shown in FIG. 1.

The fixing unit 60 is, for example, of a heating belt type and includes the pressing unit which forms a fixing nip portion for holding and conveying a sheet S, the heating unit which comes in contact with the sheet S for heating at a fixing temperature and so forth.

The fixing unit 60 includes the frame 60*a*, the upper pressure roller (fixing side member) 61 and the lower pressure roller (back side member) 64 as described above. In addition to this, this fixing unit 60 is provided with a fixing belt (fixing side member) 62, a heat roller 63, a stretching member 68 and a torque generation unit (braking force generation unit) 66.

The upper pressure roller 61 is a cylindrical metallic core made of iron or the like on which an elastic layer of silicone rubber is formed. In addition to this, a surface release layer of a fluorine resin may sometimes be formed on the outer peripheral surface of the elastic layer. The upper pressure roller 61 having such a structure can rotate to follow the lower pressure roller 64 together with the fixing belt 62 by being urged through the fixing belt 62 against the lower pressure roller 64 which is rotationally driven by a drive motor M3.

The fixing belt 62 is an endless belt member running around the upper pressure roller 61, the heat roller 63 and the stretching member 68. This fixing belt 62 serves as a heating member for heating a sheet S at a predetermined temperature when the sheet S comes in contact with the fixing belt 62. In this case, the predetermined temperature is a temperature required for supplying necessary heat to melt toner and depends, for example, on the paper type of a sheet used for printing an image.

The heat roller 63 incorporates a heat source 631 such as a halogen heater which heats the cylindrical metallic core made of aluminum or the like and the resin layer made of PTFE (polytetrafluoroethylene) or the like so that the fixing belt 62 is heated. Furthermore, a temperature sensor 81 for control is provided in the vicinity of the fixing belt 62 to detect the temperature of the fixing belt 62 (refer to FIG. 2). The temperature sensor 81 for control outputs a detection signal to the control unit 100. The control unit 100 controls the output of the heat source 631 of the heat roller 63 (for example, through on/off control) in order to adjust the temperature measured by the temperature sensor 81 to a predetermined temperature.

Incidentally, the fixing belt 62 consists of a base film made, for example, of a heat-resistant polyimide having an outer peripheral surface on which are successively stacked an elastic layer made of a silicone rubber or the like and a surface release layer made of a fluorine resin. The fluorine resin is a material which contains PFA (perfluoroalkoxyalkane), PTFE or FEP (ethylenetetrafluoride-propylenehexafluoride copolymer). More preferably, the fluorine resin is one of PFA, PTFE or FEP. This configuration improves the releasability of the surface of the fixing belt 62 against wax contained in the toner resin and toner particles so that toner hardly adheres to the surface of the fixing belt 62 when fixing the toner.

The fixing belt 62 may be heated by electromagnetic induction (IH: Induction Heating). In this case, the fixing belt is basically made of a material such as Ni which can be heated by electromagnetic induction.

The stretching member 68 is a roller rotatably supported at both ends whose outer diameter is of a reversed crown shape. The stretching member 68 is located in a predetermined position apart from the upper pressure roller 61 and the lower pressure roller 64. The stretching member 68 is provided to shift relative to the upper pressure roller 61 and the lower pressure roller 64 and can adjust the tension of the fixing belt 62 by shifting. Alternatively, instead of such a configuration, while the stretching member 68 is fixed, the tension of the fixing belt 62 can be adjusted by providing the heat roller 63 capable of moving.

Furthermore, the fixing unit 60 is provided with a switch mechanism 69. The switch mechanism 69 is provided with an urging means for urging the lower pressure roller 64 against the upper pressure roller 61, and can move the lower pressure roller 64 into and out of engagement with the upper pressure roller 61 as engagement/disengagement operation. The engagement/disengagement operation is controlled by the control unit 100.

Also, when the lower pressure roller 64 is engaged with the upper pressure roller 61, the lower pressure roller 64 is pressed by the upper pressure roller 61 to come in pressure contact with the outer peripheral surface of the fixing belt 62 while rotating to form a fixing nip portion (hereinafter referred to as "nip portion") N for holding and conveying a sheet S, on which a toner image is formed, there between. Meanwhile, the lower pressure roller 64 may incorporate a heat source such as a halogen heater.

In addition to this, the fixing unit 60 is provided with the drive motor M3 for rotationally driving the lower pressure roller 64. The drive motor M3 is controlled by the control unit 100.

The torque generation unit 66 includes motors M1 and M2 which are controlled by the control unit 100, and a gear mechanism 67 for generating a braking force in the direction to hinder rotation of the fixing belt 62 in order to adjust the differential speed between the surface speed of the fixing belt 62 and the surface speed of the lower pressure roller 64. The fixing belt 62 can rotate by following the lower pressure roller 64 which is rotationally driven by the drive motor M3. The torque generation unit 66 generates a braking force hindering this following rotation. The fixing belt 62 and the sheet S slip thereby on each other to prevent a gloss memory.

More specifically, the motors M1 and M2 apply torques in opposite directions respectively to the upper pressure roller 61. The motor (braking unit) M1 generates a braking force D2 against the upper pressure roller 61 rotating to follow the lower pressure roller 64 in the conveying direction H1 (referred to as the forward direction) by applying a torque in the reverse direction to the forward direction. In other words, the motor M1 prevents a gloss memory by generating the braking force D2 on the upper pressure roller 61 to make the fixing belt 62 and the sheet S slip on each other.

On the other hand, the motor M2 gives the upper pressure roller 61 a torque to assist the rotation of the upper pressure roller 61 following the lower pressure roller 64 by generating an assist force D1 to rotate the upper pressure roller 61 in the conveying direction H1.

Meanwhile, the gear mechanism 67 includes a plurality of gear groups for separately transmitting the rotations of the motors M1 and M2 to the upper pressure roller 61 so that the torques of the motors M1 and M2 are transmitted in combination to the upper pressure roller 61 through these gear groups.

Figure 4:
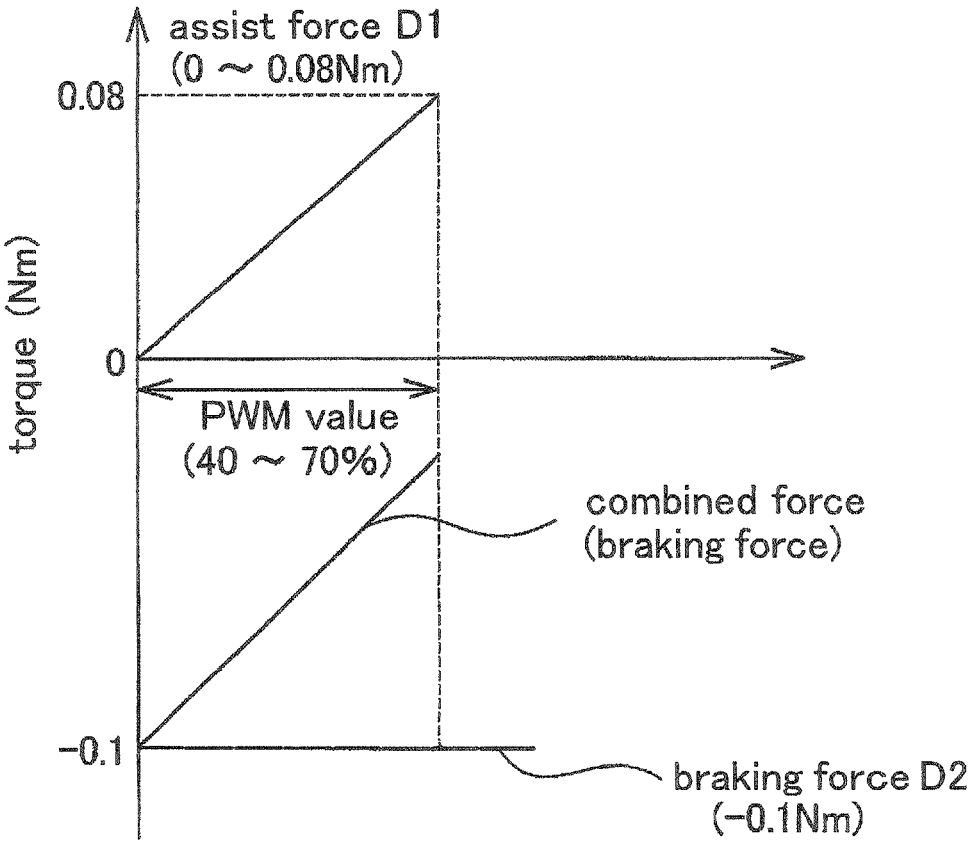
FIG. 4 is a schematic diagram for showing the braking force generated by a torque generation unit.

FIG. 4 is a schematic diagram for showing the braking force generated by the torque generation unit 66. As shown in FIG. 4, the torque (braking force D2) generated by the motor M1 is constant, i.e., −0.1 Nm in this case. On the other hand, the motor M2 is controlled by PWM (Pulse Width Modulation) to generate a variable torque (assist force D1) in a range of 0 Nm to 0.08 Nm (PWM value=40% to 70% in terms of duty cycle). The assist force D1 is thus always smaller than the braking force D2 (exactly, the absolute value of the assist force D1 is always smaller than the absolute value of the braking force D2), such that the combined force of the assist force D1 and the braking force D2 becomes a variable braking force. The combined force is the braking force generated by the torque generation unit 66 and exerted on the upper pressure roller 61, and set to reduce the surface speed (circumferential speed) of the upper pressure roller 61 by 0.3% to 0.8% relative to the surface speed (circumferential speed) of the lower pressure roller 64, resulting in slip between the fixing belt 62 and a sheet S.

Referring to FIG. 2 again, the control unit 100 of the present embodiment is provided with a torque detection unit 104. The storage unit 72 stores data indicating the correlation between the driving current supplied to the drive motor M3 and the rotational torque of the drive motor M3. The torque detection unit 104 is a device for detecting the rotational torque of the drive motor M3 by a program stored in the ROM 102 which obtains the rotational torque of the drive motor M3 from the driving current supplied to the drive motor M3 on the basis of the correlation data stored in the storage unit 72.

The control unit 100 of the present embodiment decreases the braking force generated by the torque generation unit 66 if the rotational torque of the drive motor M3 detected by the torque detection unit 104 is larger than a predetermined target torque. Conversely, the control unit 100 increases the braking force generated by the torque generation unit 66 if the rotational torque of the drive motor M3 detected by the torque detection unit 104 is smaller than the predetermined target torque. In other words, the control unit 100 increases the assist force D1 of the motor M2 to decrease the braking force if the rotational torque of the drive motor M3 detected by the torque detection unit 104 is larger than the predetermined target torque, and decreases the assist force D1 of the motor M2 to increase the braking force if the rotational torque of the drive motor M3 is smaller than the predetermined target torque.

By this configuration, while solving the gloss memory problem, the fixing unit of the present embodiment prevents the drive motor M3 from being damaged. Namely, when the torque generation unit 66 generates a braking force, an excessive load may be placed on the drive motor M3 to cause failure of the drive motor M3. Also, when the upper pressure roller 61 and the lower pressure roller 64 are expanded by heat of the heat source 631, a larger torque is required to maintain the rotation of these rollers 61 and 64, so that a further excessive load is placed on the drive motor M3 to increase the possibility of causing failure of the drive motor M3. Accordingly, even if the torque of the drive motor M3 exceeds the target torque due to expansion of the rollers 61 and 64 by temperature rise, the control unit 100 of the present embodiment performs the above control to secure the slipping amount between the fixing belt 62 and the sheet S and prevent an excessive load from being placed on the drive motor M3. On the other hand, if the torque of the drive motor M3 is smaller than the target torque, the control unit 100 increases the braking force to avoid the situation that a gloss memory appears by securing the slipping amount between the fixing belt 62 and the sheet S.

Figure 5:
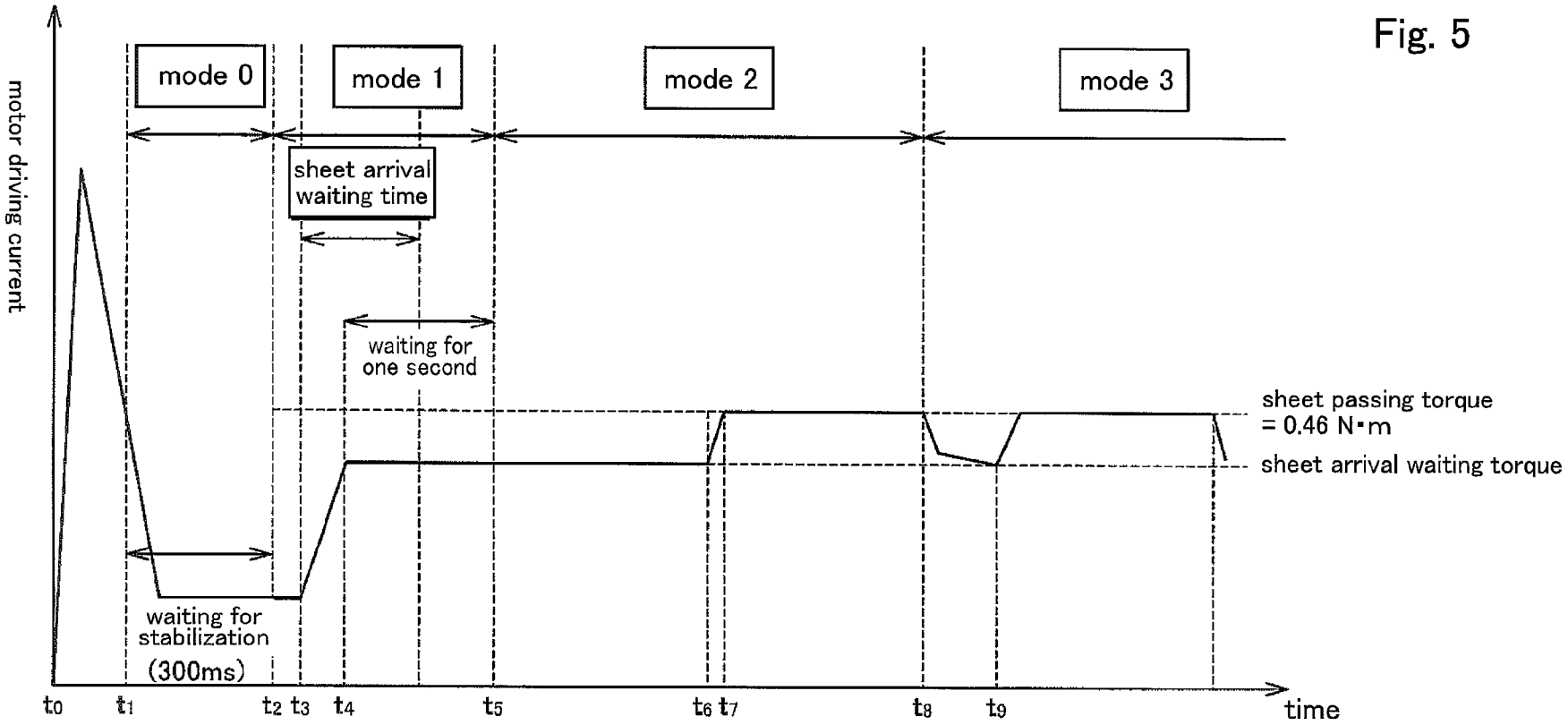
FIG. 5 is a timing chart for explaining the operation of the fixing unit of the present embodiment.

Next, the operation of the fixing unit of the present embodiment will be explained. FIG. 5 is a timing chart for explaining the operation of the fixing unit of the present embodiment. As shown in FIG. 5, the control unit 100 of the present embodiment controls the fixing unit in accordance with four control modes, i.e., modes 0 through 3. The mode 0 is provided for initial settings. The mode 1 is provided for processing a sheet in advance of passing the sheet through the fixing unit, i.e., during a sheet arrival waiting period. The modes 2 and 3 are provided for processing a sheet which is passing through the fixing unit, i.e., during a sheet passing period.

At time t0, the control unit 100 starts the drive motor M3 to rotate, and controls the switch mechanism 69 to start operation of engaging the lower pressure roller 64 and the upper pressure roller 61. The lower pressure roller 64 is engaged with the upper pressure roller 61 at time t1 to form a nip portion N. Namely, the control unit 100 forms the nip portion N in the sheet arrival waiting period before conveying a sheet S between the nip portion N.

The control mode is set to the mode 0 at time t1, and the control unit 100 waits for a stabilization waiting time (for example, 300 ms from time t0) so that rush current after powering on the drive motor M3 is stabilized. At time t2 after the stabilization waiting time elapsed, the control mode is switched from the mode 0 to the mode 1.

When the control mode is switched to the mode 1 at time t2, the torque detection unit 104 starts detecting the rotational torque of the drive motor M3. The rotational torque is detected with reference to the value of the driving current supplied to the drive motor M3. At time t3, the control unit 100 performs the process of determining whether to generate a braking force from the torque generation unit 66.

Figure 6:
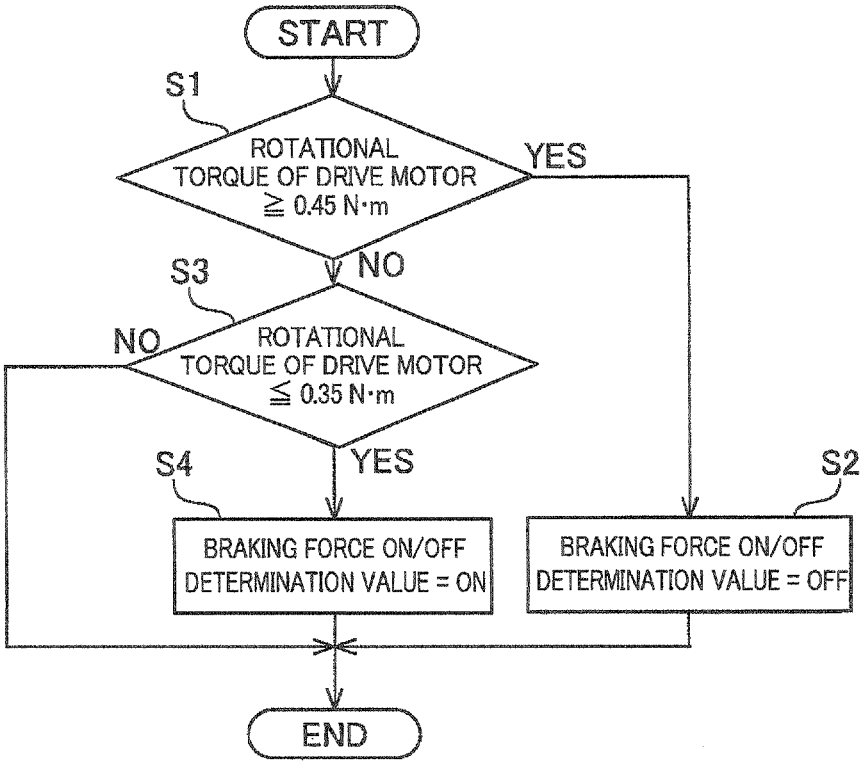
FIG. 6 is a flow chart for showing the process of determining whether to generate a braking force at time t3 shown in FIG. 5.

FIG. 6 is a flow chart for showing the process of determining whether to generate a braking force from the torque generation unit 66 at time t3 shown in FIG. 5. As shown in FIG. 6, the control unit 100 determines whether or not the rotational torque of the drive motor M3 currently detected by the torque detection unit 104 is no smaller than 0.45 N·m (S1).

If it is determined that the current rotational torque of the drive motor M3 is no smaller than 0.45 N·m. (S1: YES), the control unit 100 sets a braking force ON/OFF determination value=OFF (S2) and terminates the process shown in FIG. 6. When this braking force ON/OFF determination value is set to OFF, no braking force is applied to the upper pressure roller 61.

If it is determined that the current rotational torque of the drive motor M3 is smaller than 0.45 N·m. (S1: NO), the control unit 100 determines whether or not the current rotational torque of the drive motor M3 is no larger than 0.35 N·m (S3). If it is determined that the current rotational torque of the drive motor M3 is no larger than 0.35 N·m (S3: YES), the control unit 100 sets a braking force ON/OFF determination value=ON (S4) and terminates the process shown in FIG. 6. When this braking force ON/OFF determination value is set to ON, a braking force is applied to the upper pressure roller 61 as described above.

If it is determined that the current rotational torque of the drive motor M3 is larger than 0.35 N·m. (S3: NO), the control unit 100 maintains the braking force ON/OFF determination value as it is and terminates the process shown in FIG. 6.

Referring to FIG. 5 again, if the control unit 100 determines to apply a braking force at time t3, a PI control is started. This PI control is a control of adjusting a braking force in accordance with a rotational torque which is detected. Specifically, the control unit 100 decreases the braking force generated by the torque generation unit 66 if the rotational torque of the drive motor M3 detected by the torque detection unit 104 is larger than a predetermined sheet arrival waiting torque, and increases the braking force generated by the torque generation unit 66 if the rotational torque of the drive motor M3 detected by the torque detection unit 104 is smaller than the predetermined sheet arrival waiting torque.

The driving current supplied to the drive motor M3 increases after time t3. After starting the drive motor M3, the torque thereon is smaller than the sheet arrival waiting torque. The control unit 100 thereby increases the torque generated by the torque generation unit 66. When the torque generated by the torque generation unit 66 increases, the load placed on the drive motor M3 increases, and then the driving current supplied to the drive motor M3 increases.

Incidentally, the proportional constant of the PI control is set to a higher value in the sheet arrival waiting period so that the torque applied to the drive motor M3 can reach the predetermined sheet arrival waiting torque in a relatively short time (within the sheet arrival waiting time shown in FIG. 5). Then, when the torque of the drive motor M3 detected by the torque detection unit 104 at time t4 reaches the predetermined sheet arrival waiting torque, the control unit 100 waits for about 1 second during which, if no substantial variation occurs in the detected torque, it is determined at time t5 that the torque of the drive motor M3 has been stabilized at the predetermined sheet arrival waiting torque. The control unit 100 thereby terminates the mode 1 and enters the mode 2.

After switching the control mode to the mode 2 at time t5, the control unit 100 waits until the leading edge of the first sheet S enters the nip portion N. When the leading edge of the first sheet S enters the nip portion N at time t6, a sheet passing period is started in which the sheet S is conveyed by the nip portion N. The control unit 100 decreases the braking force generated by the torque generation unit 66 if the rotational torque of the drive motor M3 detected by the torque detection unit 104 is larger than a predetermined sheet passing torque in the sheet passing period, and increases the braking force generated by the torque generation unit 66 if the rotational torque of the drive motor M3 detected by the torque detection unit 104 is smaller than the predetermined sheet passing torque.

In this case, the sheet passing torque is set to a larger value than the sheet arrival waiting torque. Because of this, the control unit 100 controls the torque generation unit 66 to increase the braking force. When the torque generated by the torque generation unit 66 increases, the load placed on the drive motor M3 increases, and then the driving current supplied to the drive motor M3 increases.

Incidentally, the proportional constant of the PI control is set to a lower value in the sheet passing period than in the sheet arrival waiting period. Because of this, the torque of the drive motor M3 detected by the torque detection unit 104 is relatively gradually changed to reach the sheet passing torque at time t7. The control unit 100 sets the sheet passing torque in advance in order that, while solving the gloss memory problem, the drive motor M3 is prevented from being damaged. On the other hand, while the sheet passing period, the control unit 100 sets the sheet arrival waiting torque which is variable, to an appropriate value in accordance with the type of paper (particularly, thickness) of a sheet S to be conveyed. Namely, the thicker the sheet S is, the larger the increment of the torque when conveying the sheet S through the nip portion N. Taking this increment into consideration, the control unit 100 determines the sheet arrival waiting torque in order that the torque of the drive motor M3 can reach the sheet passing torque smoothly after a sheet enters the nip portion N.

Then, when the first sheet S is passed through the nip portion N at time t8, the control mode is switched from the mode 2 to the mode 3.

Incidentally, the control unit 100 estimates the interval between adjacent sheets S in the sheet passing period. The period after a sheet is passed through the nip portion N and before the subsequent sheet enters the nip portion N is called an interval period. When the control mode is switched to the mode 3, the control unit 100 does thereby not change the braking force, rather than performing the above PI control, through the interval period. That is to say, the control unit 100 fixes the braking force in the interval period from time t8 to time t9.

After the leading edge of the second sheet S enters the nip portion N at time t9, the control unit 100 decreases the braking force generated by the torque generation unit 66 if the rotational torque of the drive motor M3 detected by the torque detection unit 104 is larger than the predetermined sheet passing torque, and increases the braking force generated by the torque generation unit 66 if the rotational torque of the drive motor M3 is smaller than the predetermined sheet passing torque, in the same manner as the above control performed after time t6. Thereafter, for the third and subsequent sheets, the control unit 100 adjusts the braking force in the same manner as for the second sheet.

Figure 7:
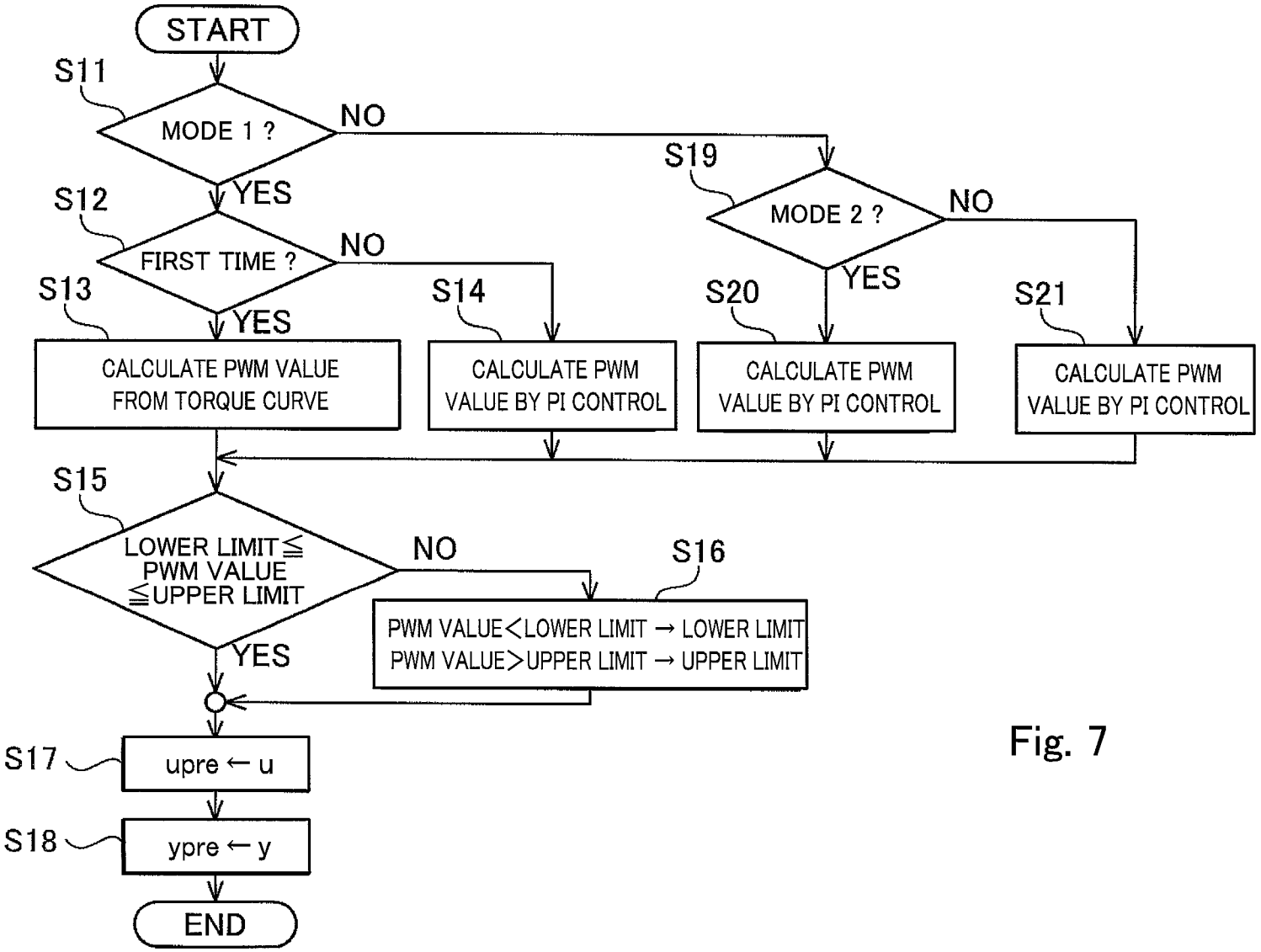
FIG. 7 is a flow chart showing the process performed by the fixing unit according to the present embodiment in detail.

FIG. 7 is a flow chart showing the process performed by the fixing unit according to the present embodiment in detail. Incidentally, the process shown in FIG. 7 is the process to be performed after time t2 shown in FIG. 5. Furthermore, the process shown in FIG. 7 is repeated until the image forming apparatus 1 is powered off.

The control unit 100 determines whether or not the control mode is the mode 1 (S11). If it is determined that the control mode is the mode 1 (S11: YES), the control unit 100 determines whether or not the motor M2 performs an assist operation for the first time (S12).

If it is for the first time that the motor M2 performs an assist operation (S12: YES), the control unit 100 calculates a PWM value to be applied to the motor M2 on the basis of the torque curve stored in advance (S13). Specifically, the control unit 100 calculates 1) the torque of the motor M2 corresponding to the current value of the motor M2, and 2) the PWM value of the motor M2 by calculating the differential torque, i.e., the difference between the calculated torque and the target value. The process then proceeds to step S15.

Conversely, if it is not for the first time that the motor M2 performs an assist operation (S12: NO), the control unit 100 calculates a PWM value to be applied to the motor M2 by the PI control (S14). In this case, the control unit 100 calculates the PWM value on the basis of a calculation formula, i.e., PWM value (y)=previous PWM value (ypre)−(b1×differential torque (u)+b2×previous differential torque (upre)). These previous values are values calculated one cycle before.

In the formula, b1 is a proportional constant kp, and b2 is a proportional constant kp×(ki_kp×ts−1).

The proportional constant kp is 0.4 in the mode 1. The constant ki_kp is (integral control constant/proportional constant) which is 2 in this case. The constant ts is a control cycle, for example, 100 ms.

The control unit 100 calculates the PWM value on the basis of the above calculation formula, and the process proceeds to step S15.

In step S15, the control unit 100 determines whether or not the PWM value calculated in steps S13 and S14 falls within the range of no lower than a lower limit (for example, 40%) and no higher than an upper limit (for example, 70%). If it is determined that the calculated PWM value falls within the range (S15: YES), the process proceeds to step S17.

Conversely, if it is determined that the calculated PWM value is out of the range of no lower than the lower limit and no higher than the upper limit (S15: NO), the control unit 100 performs the process of making the PWM value fall within this range in step S16. Namely, if the PWM value is calculated as a value which is lower than the lower limit, the control unit 100 sets the PWM value to the lower limit. On the other hand, if the PWM value is calculated as a value which is upper than the upper limit, the control unit 100 sets the PWM value to the upper limit. The process then proceeds to step S17.

In step S17, the control unit 100 substitutes the differential torque (u) which is currently calculated, for the differential torque (upre) which has been calculated one cycle before. Next, in step S18, the control unit 100 substitutes the PWM value (y) which is currently calculated for the PWM value (ypre) which has been calculated one cycle before. Then, the process shown in FIG. 7 is terminated.

If it is determined that the control mode is not the mode 1 (S11: NO), the control unit 100 determines whether or not the control mode is the mode 2 (S19). If it is determined that the control mode is the mode 2 (S19: YES), the control unit 100 calculates the PWM value of the motor M2 by the PI control (S20). At this time, the control unit 100 calculates the PWM value on the basis of the calculation formula, i.e., PWM value (y)=previous PWM value (ypre)−(b1×differential torque (u)+b2×previous differential torque (upre)). The proportional constant kp is set to 0.04 in step S19. ki_kp in this case is 2 which is the same as in the mode 1.

The process then proceeds to step S15 so that the process in steps S15 to S18 is performed as has been discussed above, and then the process shown in FIG. 7 is terminated.

If it is determined that the control mode is not the mode 2 (S19: NO), the control unit 100 determines that the control mode is the mode 3 and calculates the PWM value of the motor M2 by the PI control (S21). In this case, the control unit 100 performs the same process as in step S20. Namely, the control unit 100 calculates the PWM value on the basis of a calculation formula, i.e., PWM value (y)=previous PWM value (ypre)−(b1×differential torque (u)+b2×previous differential torque (upre)). Incidentally, the proportional constants kp and ki_kp used in step S21 are the same as in the mode 2.

Thereafter, the process proceeds to step S15 so that the process in steps S15 to S18 is performed as has been discussed above, and then the process shown in FIG. 7 is terminated.

As described above, in accordance with the image forming apparatus 1 of the present embodiment, the braking force is decreased if the rotational torque of the drive motor M3 is larger than the predetermined target torque. Because of this, when the upper pressure roller 61 and the lower pressure roller 64 are expanded by temperature rise, the rotational torque of the drive motor M3 exceeds the target torque so that the braking force is decreased. Accordingly, it is possible to prevent an excessive load from being placed on the drive motor M3, while securing the slipping amount between the fixing belt 62 and the sheet S. On the other hand, the braking force is increased if the rotational torque of the drive motor M3 is smaller than the predetermined target torque. It is therefore possible to avoid the situation that a gloss memory appears by securing the slipping amount between the fixing belt 62 and the sheet S. Accordingly, while solving the gloss memory problem, it is possible to prevent the drive motor M3 from being damaged.

Furthermore, in the sheet arrival waiting period, the image forming apparatus 1 forms the nip portion N by engaging the lower pressure roller 64 with the upper pressure roller 61 through the fixing belt 62, and decreases the braking force if the rotational torque of the drive motor M3 is larger than the predetermined sheet arrival waiting torque, and increases the braking force if the rotational torque of the drive motor M3 is smaller than the predetermined sheet arrival waiting torque. By this configuration, it is possible to stabilize the torque before passing a sheet through the nip portion N, and secure an appropriate slipping amount of the first sheet S conveyed by the fixing unit so that the gloss memory problem can be solved.

On the other hand, in the sheet passing period, the image forming apparatus 1 decreases the braking force if the rotational torque of the drive motor M3 is larger than the predetermined sheet passing torque, and increases the braking force if the rotational torque of the drive motor M3 is smaller than the predetermined sheet passing torque. Because of this, in the case where a plurality of sheets S are passed through, the braking force to be generated to pass a sheet S can be adjusted with reference to the torque applied when conveying the previous sheet S, and it is therefore possible to prevent the drive motor M3 from being damaged while solving the gloss memory problem.

Also, the image forming apparatus 1 estimates the interval between adjacent sheets S in the sheet passing period, and does not change the braking force through the interval period. Because of this, when no sheet is intervening between the fixing belt 62 and the lower pressure roller 64 to lower the torque, the braking force is not changed to prevent inappropriate adjustment of the braking force.

On the other hand, the image forming apparatus 1 sets the sheet arrival waiting torque to a lower value in a sheet arrival waiting period than the sheet passing torque in a sheet passing period. It is therefore possible to solve the gloss memory problem by adjusting the sheet arrival waiting torque in a sheet arrival waiting period for a torque increment when passing a sheet S, and securing an appropriate slipping amount of the first sheet S.

The image forming apparatus 1 determines the sheet arrival waiting torque in accordance with the paper type of a sheet S to be conveyed. The sheet arrival waiting torque can thereby be determined in accordance with the thickness of the sheet S so that the slipping amount of the first sheet S can be made further appropriate.

In addition to this, the image forming apparatus 1 sets the proportional constant kp of the PI control in the sheet passing period to a lower value than the proportional constant kp of the PI control in the sheet arrival waiting period. The braking force can thereby be quickly adjusted in the sheet arrival waiting period to quickly obtain an appropriate braking force in advance of passing the first sheet S. Also, in the sheet passing period, it is possible to prevent the braking force from substantially fluctuating due to noise or the like.

In addition, while the braking force of the motor M1 is fixed, the image forming apparatus 1 adjusts the assist force to adjust the combined braking force. Because of this, the effective braking force can be adjusted in a simple manner by adjusting the assist force without need for directly adjusting the braking force.

Furthermore, the image forming apparatus 1 is provided with the image forming unit 40 for forming a toner image on a sheet S and the fixing unit for fixing the toner images formed on the sheet S by the image forming unit 40, and thereby can output a printed sheet which is improved in terms of image glosses.

The foregoing description has been presented on the basis of the embodiments. However, it is not intended to limit the present invention to the precise form described, and obviously many modifications and variations are possible without departing from the scope of the invention as well as any combination of these embodiments.

For example, in the case of the above embodiment, the fixing unit is a belt nip type unit. However, the present invention is not limited thereto but can be applied to a roller nip type fixing unit.

Also, while the fixing unit of the present embodiment is housed in the image forming apparatus 1, the present invention is not limited thereto but can be applied even if the fixing unit is housed in a finisher or another apparatus.

Furthermore, in accordance with the present invention, the configurations, the numerals and the like are not limited to those as described above, but can be changed in any appropriate manner.

What is claimed is:

1. An image forming apparatus comprising:

a fixing side member configured to rotate;

a back side member configured to rotate in contact with an outer peripheral surface of the fixing side member under pressure, and to cooperate with the fixing side member for forming a fixing nip portion and holding and conveying a sheet with a toner image between the back side member and the fixing side member;

a drive motor configured to rotate the back side member;

a braking force generation unit configured to generate a braking force in a direction to hinder rotation of the fixing side member to set a differential speed between a surface speed of the fixing side member and a surface speed of the back side member;

a control unit configured to adjust the braking force generated by the braking force generation unit; and a torque detection unit configured to detect a rotational torque of the drive motor, wherein the control unit adjusts the braking force generated by the braking force generation unit to decrease if the rotational torque of the drive motor detected by the torque detection unit is larger than a predetermined target torque, and to increase if the rotational torque of the drive motor detected by the torque detection unit is smaller than the predetermined target torque, wherein the braking force generation unit comprises a braking unit which generates a braking force in the direction to hinder rotation of the fixing side member and an assist unit which generates, within a range not exceeding the braking force generated by the braking unit, an assist force in a direction opposite to the braking force generated by the braking unit to assist the rotation of the fixing side member, and wherein while the braking force generated by the braking unit is fixed, the control unit adjusts the braking force generated by the braking force generation unit by adjusting the assist force generated by the assist unit.

2. The image forming apparatus of claim 1, wherein the fixing side member and the back side member are configured to engage and disengage under control of the control unit which, in a sheet arrival waiting period before conveying a sheet between the fixing nip portion, engages the fixing side member and the back side member to form the fixing nip portion, and adjusts the braking force generated by the braking force generation unit to decrease if the rotational torque of the drive motor detected by the torque detection unit is larger than a predetermined sheet arrival waiting torque, and to increase if the rotational torque of the drive motor detected by the torque detection unit is smaller than the predetermined sheet arrival waiting torque.

3. The image forming apparatus of claim 2, wherein in a sheet passing period in which a sheet is conveyed through the fixing nip portion, the control unit adjusts the braking force generated by the braking force generation unit to decrease if the rotational torque of the drive motor detected by the torque detection unit is larger than a predetermined sheet passing torque, and to increase if the rotational torque of the drive motor detected by the torque detection unit is smaller than the predetermined sheet passing torque.

4. The image forming apparatus of claim 3, wherein the control unit estimates an interval period between adjacent sheets in the sheet passing period, and does not change the braking force through the interval period.

5. The image forming apparatus of claim 3, wherein the control unit sets the predetermined sheet arrival waiting torque to a lower value in the sheet arrival waiting period than the predetermined sheet passing torque in the sheet passing period.

6. The image forming apparatus of claim 5, wherein the control unit determines the predetermined sheet arrival waiting torque in accordance with a paper type of a sheet to be conveyed through the fixing nip portion in the sheet passing period.

7. The image forming apparatus of claim 3, wherein the control unit adjusts the braking force generated by the braking force generation unit by a PI control with a proportional constant which is set to a lower value in the sheet passing period than in the sheet arrival waiting period.

8. The image forming apparatus of claim 1, wherein in a sheet passing period in which a sheet is conveyed through the fixing nip portion, the control unit adjusts the braking force generated by the braking force generation unit to decrease if the rotational torque of the drive motor detected by the torque detection unit is larger than a predetermined sheet passing torque, and to increase if the rotational torque of the drive motor detected by the torque detection unit is smaller than the predetermined sheet passing torque.

9. An image forming apparatus comprising:

a fixing side member configured to rotate;

a back side member configured to rotate in contact with an outer peripheral surface of the fixing side member under pressure, and to cooperate with the fixing side member for forming a fixing nip portion and holding and conveying a sheet with a toner image between the back side member and the fixing side member;

a drive motor configured to rotate the back side member;

a braking force generation unit configured to generate a braking force in a direction to hinder rotation of the fixing side member to set a differential speed between a surface speed of the fixing side member and a surface speed of the back side member;

a control unit configured to adjust the braking force generated by the braking force generation unit; and a torque detection unit configured to detect a rotational torque of the drive motor, wherein the control unit adjusts the braking force generated by the braking force generation unit to decrease if the rotational torque of the drive motor detected by the torque detection unit is larger than a predetermined target torque, and to increase if the rotational torque of the drive motor detected by the torque detection unit is smaller than the predetermined target torque, wherein the fixing side member and the back side member are configured to engage and disengage under control of the control unit which, in a sheet arrival waiting period before conveying a sheet between the fixing nip portion, engages the fixing side member and the back side member to form the fixing nip portion, and adjusts the braking force generated by the braking force generation unit to decrease if the rotational torque of the drive motor detected by the torque detection unit is larger than a predetermined sheet arrival waiting torque, and to increase if the rotational torque of the drive motor detected by the torque detection unit is smaller than the predetermined sheet arrival waiting torque, wherein in a sheet passing period in which a sheet is conveyed through the fixing nip portion, the control unit adjusts the braking force generated by the braking force generation unit to decrease if the rotational torque of the drive motor detected by the torque detection unit is larger than a predetermined sheet passing torque, and to increase if the rotational torque of the drive motor detected by the torque detection unit is smaller than the predetermined sheet passing torque, and wherein the control unit sets the predetermined sheet arrival waiting torque to a lower value in the sheet arrival waiting period than the predetermined sheet passing torque in the sheet passing period.

10. The image forming apparatus of claim 9, wherein the control unit determines the predetermined sheet arrival waiting torque in accordance with a paper type of a sheet to be conveyed through the fixing nip portion in the sheet passing period.

11. An image forming apparatus comprising:

a fixing side member configured to rotate;

a back side member configured to rotate in contact with an outer peripheral surface of the fixing side member under pressure, and to cooperate with the fixing side member for forming a fixing nip portion and holding and conveying a sheet with a toner image between the back side member and the fixing side member;

a drive motor configured to rotate the back side member;

a braking force generation unit configured to generate a braking force in a direction to hinder rotation of the fixing side member to set a differential speed between a surface speed of the fixing side member and a surface speed of the back side member;

a control unit configured to adjust the braking force generated by the braking force generation unit; and a torque detection unit configured to detect a rotational torque of the drive motor, wherein the control unit adjusts the braking force generated by the braking force generation unit to decrease if the rotational torque of the drive motor detected by the torque detection unit is larger than a predetermined target torque, and to increase if the rotational torque of the drive motor detected by the torque detection unit is smaller than the predetermined target torque, wherein the fixing side member and the back side member are configured to engage and disengage under control of the control unit which, in a sheet arrival waiting period before conveying a sheet between the fixing nip portion, engages the fixing side member and the back side member to form the fixing nip portion, and adjusts the braking force generated by the braking force generation unit to decrease if the rotational torque of the drive motor detected by the torque detection unit is larger than a predetermined sheet arrival waiting torque, and to increase if the rotational torque of the drive motor detected by the torque detection unit is smaller than the predetermined sheet arrival waiting torque, wherein in a sheet passing period in which a sheet is conveyed through the fixing nip portion, the control unit adjusts the braking force generated by the braking force generation unit to decrease if the rotational torque of the drive motor detected by the torque detection unit is larger than a predetermined sheet passing torque, and to increase if the rotational torque of the drive motor detected by the torque detection unit is smaller than the predetermined sheet passing torque, and wherein the control unit adjusts the braking force generated by the braking force generation unit by a PI control with a proportional constant which is set to a lower value in the sheet passing period than in the sheet arrival waiting period.

* * * * *